US009127528B2

(12) United States Patent
Panian

(10) Patent No.: US 9,127,528 B2
(45) Date of Patent: Sep. 8, 2015

(54) MULTI-POSITION TOOL ACTUATION SYSTEM

(75) Inventor: Tyler D. Panian, Seal Beach, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 905 days.

(21) Appl. No.: 12/703,398

(22) Filed: Feb. 10, 2010

(65) Prior Publication Data

US 2011/0132618 A1 Jun. 9, 2011

Related U.S. Application Data

(60) Provisional application No. 61/267,501, filed on Dec. 8, 2009.

(51) Int. Cl.
*E21B 34/10* (2006.01)
*E21B 41/00* (2006.01)

(52) U.S. Cl.
CPC ..... *E21B 41/00* (2013.01); *E21B 34/10* (2013.01)

(58) Field of Classification Search
CPC ..... E21B 41/00; E21B 23/00; E21B 34/00; E21B 34/10; E21B 34/108
USPC ..... 166/373, 374, 375, 381, 383, 386, 319
See application file for complete search history.

(56) References Cited

U.S. PATENT DOCUMENTS

| | | | | |
|---|---|---|---|---|
| 4,442,902 | A | 4/1984 | Doremus et al. | |
| 5,865,254 | A | 2/1999 | Huber et al. | |
| 5,947,205 | A * | 9/1999 | Shy | 166/319 |
| 6,502,640 | B2 | 1/2003 | Rayssiguier et al. | |
| 6,513,594 | B1 * | 2/2003 | McCalvin et al. | 166/320 |
| 6,536,530 | B2 | 3/2003 | Schultz et al. | |
| 6,585,051 | B2 * | 7/2003 | Purkis et al. | 166/374 |
| 6,668,935 | B1 | 12/2003 | McLoughlin et al. | |
| 6,782,952 | B2 | 8/2004 | Garay et al. | |
| 7,013,980 | B2 | 3/2006 | Purkis et al. | |
| 7,201,230 | B2 | 4/2007 | Schultz et al. | |
| 7,510,013 | B2 * | 3/2009 | Kimpel | 166/373 |
| 8,006,768 | B2 * | 8/2011 | Powell et al. | 166/375 |
| 8,157,016 | B2 * | 4/2012 | James | 166/375 |
| 8,215,408 | B2 * | 7/2012 | Yapici | 166/375 |
| 2004/0069491 | A1 * | 4/2004 | Garay et al. | 166/320 |
| 2005/0039914 | A1 * | 2/2005 | Purkis et al. | 166/250.15 |
| 2005/0279496 | A1 | 12/2005 | Fontenot et al. | |
| 2007/0102163 | A1 | 5/2007 | Heath et al. | |
| 2008/0000643 | A1 * | 1/2008 | Kimpel | 166/373 |
| 2009/0223675 | A1 | 9/2009 | Li et al. | |
| 2010/0051289 | A1 * | 3/2010 | Constantine et al. | 166/373 |

FOREIGN PATENT DOCUMENTS

| | | | |
|---|---|---|---|
| GB | 2417560 | A | 3/2006 |
| WO | 2004083970 | A2 | 9/2004 |

* cited by examiner

*Primary Examiner* — Elizabeth Gitlin
(74) *Attorney, Agent, or Firm* — David J. Groesbeck; Brandon Clark

(57) ABSTRACT

A technique facilitates control over a multi-position well tool. A hydraulic control module may be engaged with a multi-position well tool for controlling actuation of the multi-position well tool through a plurality of actuation positions. The multi-position well tool is moved through the plurality of actuation positions by applying pressurized fluid through a first control line. A metering piston is uniquely arranged within the hydraulic control module to control actuation of the multi-position well tool from an initial actuation position through a plurality of incremental actuation positions. Additionally, a single pressurization of actuation fluid delivered through a second control line may be used to return the multi-position well tool back to the initial actuation position from any incremental position.

9 Claims, 6 Drawing Sheets

MULTI-POSITION TOOL ACTUATION SYSTEM

RELATED APPLICATION

This application claims the benefit under 35 U.S.C. §119 (e) to U.S. Provisional Patent Application Ser. No. 61/267,501 entitled, "MULTI-POSITION TOOL ACTUATION SYSTEM," filed Dec. 8, 2009, and is hereby incorporated by reference in its entirety.

BACKGROUND

The following descriptions and examples are not admitted to be prior art by virtue of their inclusion in this section.

In many well applications, flow control valves are positioned downhole in a well to control the flow of various fluids, such as production fluids or injection fluids. The flow control valves are actuated by pressurized hydraulic fluid delivered downhole through control lines. In some applications, the flow control valves are multi-position flow control valves in which actuation of the valve through incremental positions is controlled by a J-slot mechanism. Attempts also have been made to control movement through the incremental positions via fluid metering systems, however the J-slot mechanisms and metering systems have functional limitations in controlling the sequencing and positioning of the flow control valve.

SUMMARY

In general, embodiments of the present disclosure comprise a system and methodology for controlling a multi-position well tool, such as a multi-position flow control valve. A hydraulic control module is designed for engagement with a multi-position well tool and with a pair of control lines. The hydraulic control module controls actuation of the multi-position well tool through a plurality of actuation positions by applying pressurized fluid through a first control line of the pair of control lines. A metering piston is uniquely arranged within the hydraulic control module to control actuation of the multi-position well tool from an initial actuation position through a plurality of incremental actuation positions. Additionally, a single pressurization of actuation fluid delivered through a second control line of the pair of control lines may be used to return the multi-position well tool back to the initial actuation position from any incremental position.

Other or alternative features will become apparent from the following description, from the drawings, and from the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various described technologies. The drawings are as follows.

DETAILED DESCRIPTION

In the following description, numerous details are set forth to provide an understanding of various exemplary embodiments of the present disclosure. However, it will be understood by those of ordinary skill in the art that embodiments of the present disclosure may be practiced without these details and that numerous variations or modifications from the described embodiments may be possible.

Embodiments of the present disclosure generally relate to a system and methodology for actuation of tools, such as well tools located downhole in a wellbore. The technique provides a new way for operating a dual control line multi-position tool, such as a multi-position flow control valve that may be employed in a well application. A discrete volume of hydraulic fluid is metered through a first control line in a controlled manner to increment the tool from one position to the next incremental position. This process may be repeated for multiple incremental positions. In a multi-position flow control valve embodiment, for example, the valve may be transitioned from a closed position through a plurality of incrementally open positions to a fully open position. However, the multi-position tool may be returned at any point to its initial position with a single pressure actuation applied through a second control line, while exhausting the actuation fluid through the first control line.

According to one embodiment, the multi-position tool is provided as a component in well completion equipment. For example, a multi-position flow control valve may be incorporated into completion equipment to provide flow control with multiple choking positions. Only two pressurized hydraulic control lines are required to operate the multi-position flow control valve. A first control line is used to increment the valve to each incremental choking position via a pressure actuation on the first control line. The valve may be fully closed from any incremental position with a single pressure actuation applied to a second control line.

Figure 1:
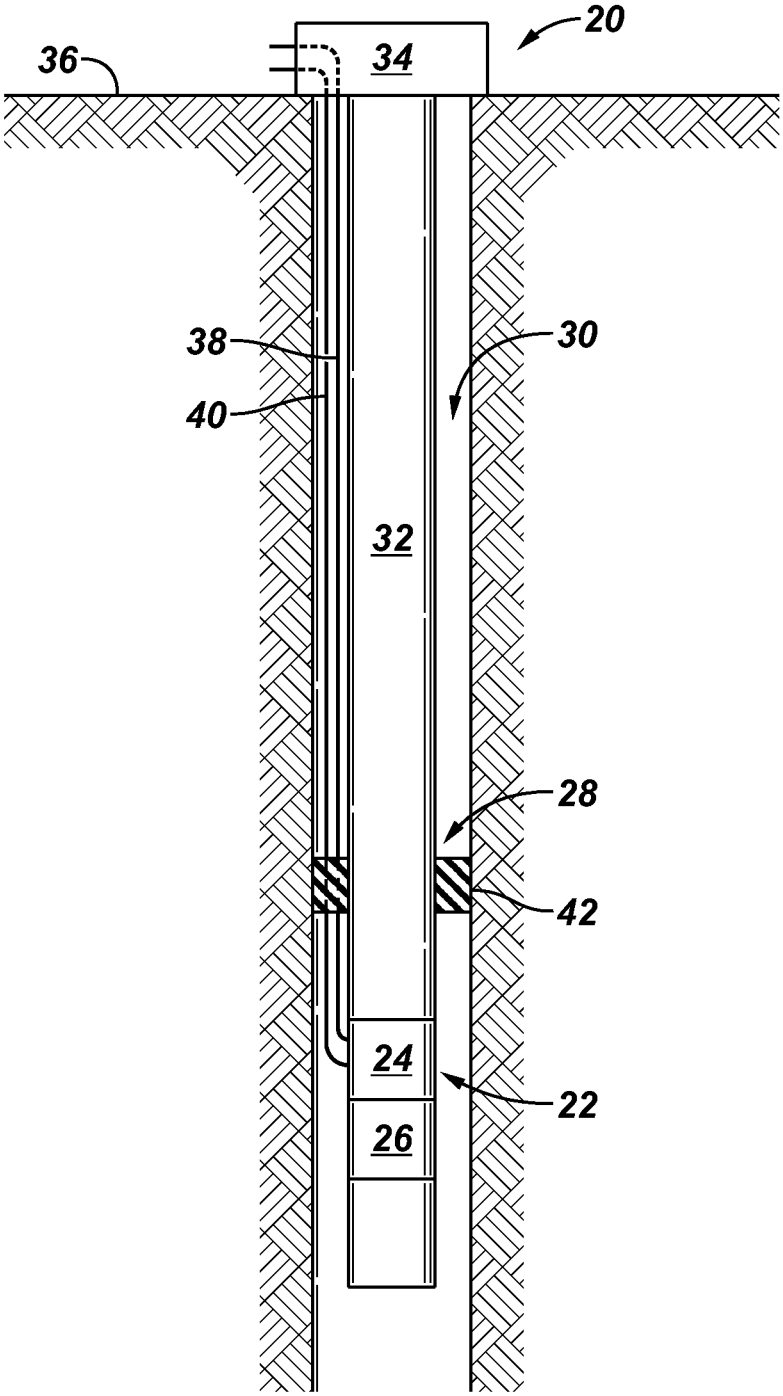
FIG. 1 is a schematic view of one example of a well control system having a hydraulic control module coupled to a multi-position well tool, according to an embodiment of the present disclosure.

Referring generally to FIG. 1, one example of a well system 20 is illustrated as having an actuation system 22 comprising a hydraulic control module 24 operatively coupled with a multi-position tool 26. By way of example, hydraulic control module 24 and multi-position tool 26 may be part of, or positioned for cooperation with, completion equipment 28, illustrated as positioned in a wellbore 30. The completion equipment 28 may be deployed downhole by a suitable conveyance 32, such as coiled tubing or production tubing. The conveyance 32 extends downhole from appropriate surface equipment, such as a wellhead 34, positioned at a surface location 36.

The hydraulic control module 24 is used to control transition of the multi-position tool 26 through a plurality of incremental actuation positions. For example, if the multi-position tool 26 comprises a multi-position flow control valve, hydraulic control module 24 may be used to control transition of the valve between multiple positions that allow differing amounts of flow through the valve. As illustrated, hydraulic control module 24 is controlled by two hydraulic control lines, such as a first control line 38 and a second control line 40. In some applications, completion equipment 28 may comprise one or more packers 42 designed to allow control lines 38, 40 to pass-through for coupling with hydraulic control module 24.

Figure 2:
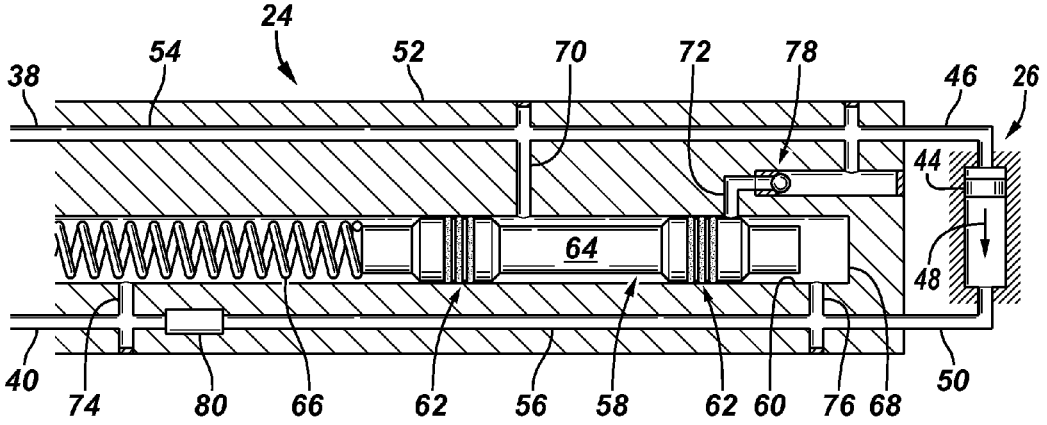
FIG. 2 is a schematic illustration of the hydraulic control module illustrated in FIG. 1, according to an embodiment of the present disclosure.

Referring generally to FIG. 2, one embodiment of hydraulic control module 24 is illustrated as coupled to multi-position tool 26. Tool 26 may be a multi-position flow control valve or other type of tool actuatable through a plurality of incremental positions. In any of these embodiments, the multi-position tool 26 comprises an actuator 44 that is moved from one incremental position to the next by an inflow of hydraulic actuation fluid through first control line 38. Hydraulic actuation fluid is pressurized in first control line 38, flows through hydraulic control module 24, through a tool connection 46, and into a front side of the multi-position tool 26. The pressurized fluid moves against a first side of actuator 44 to incrementally move the actuator in a direction represented by arrow 48. Hydraulic control module 24 effectively limits/controls the amount of movement of actuator 44.

As the actuator 44 is moved to a next incremental position, actuation fluid on an opposite or second side of actuator 44 is forced out of a back side of multi-position tool 26 through a tool connection 50 and into the hydraulic control module 24. As explained in greater detail below, the hydraulic control module 24 is used for limiting the amount of fluid passing through tool connection 50, thus controlling the incremental movement of actuator 44. From any incremental position, actuator 44 may be returned to its initial position with a single pressurization applied through second control line 40, resulting in the actuation fluid on the first side of actuator 44 being exhausted back through first control line 38.

As illustrated in FIG. 2, hydraulic control module 24 comprises a control module housing 52 having a first control line passage 54 and a second control line passage 56. First control line passage 54 forms part of the first control line 38 and conducts actuation fluid through the front side of multi-position tool 26 via tool connection 46. Similarly, second control line passage 56 forms part of the second control line 40 and may be used in conducting actuation fluid flow to or from the back side of the multi-position tool 26 via tool connection 50.

The hydraulic control module 24 also comprises a metering piston 58 slidably disposed in a metering piston cylinder 60, which is separated from both first control line passage 54 and second control line passage 56. In other words, the metering piston 58 moves generally along an axis within control module housing 52, but the axis is separated/displaced from the control line passages 54, 56. Metering piston 58 controls the amount of fluid that flows to the first side of actuator 44 during movement of the actuator 44 to a next incremental position. In this embodiment, metering piston 58 comprises a pair of seals 62, such as seal stacks, separated by a middle region 64. The seals 62 seal against a surrounding wall forming the metering piston cylinder 60. Additionally, a spring member 66, e.g. a coil spring, may be positioned to bias metering piston 58 toward an end 68 of metering piston cylinder 60.

In the illustrative embodiment, first control line passage 54 is in fluid communication with metering piston cylinder 60 at a first location and a second location via flow channels 70 and 72, respectively. Additionally, second control line passage 56 is in fluid communication with metering piston cylinder 60 at a third location and a fourth location via flow channels 74 and 76, respectively. The flow channels 70, 72, 74, 76 may be formed as ports through control module housing 52 between metering piston cylinder 60 and the corresponding control line passages. A hydraulic check valve 78 is located in the second location flow channel 72 between control line passage 54 and metering piston cylinder 60. Also, a pressure relief valve 80 is disposed in second control line passage 56. In the embodiment illustrated, the pressure relief valve 80 is located between the points at which flow channels 74 and 76 join second control line passage 56.

Figure 3:
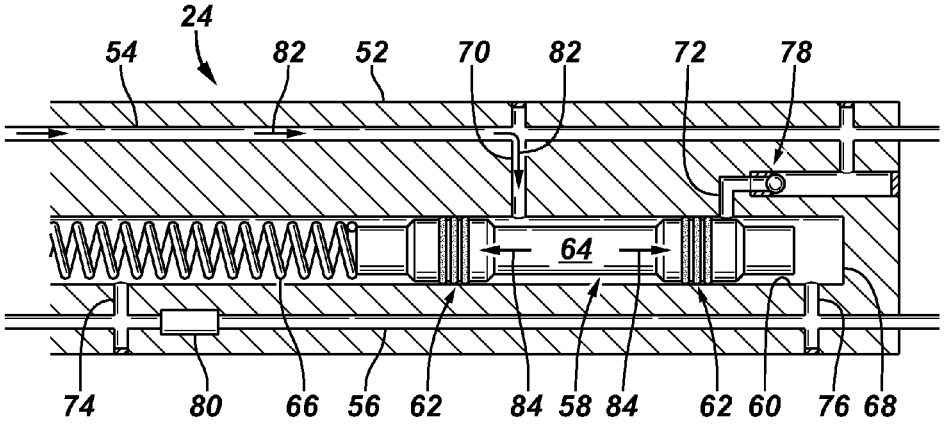
FIG. 3 is a schematic illustration similar to that of FIG. 2 illustrating a blocked fluid flow, according to an embodiment of the present disclosure.

To incrementally actuate tool 26, e.g. flow control valve 26, pressurized fluid is provided through first control line 38 to move actuator 44 from its initial position illustrated in FIG. 2. Hydraulic fluid may be applied via first control line 38 at the same pressure to achieve each incremental movement of actuator 44, and that pressurized actuation fluid is initially applied in first control line passage 54 as indicated by arrows 82 in FIG. 3. The pressure indicated by arrows 82 is communicated through the first flow channel 70 to the middle region 64 of metering piston 58. The result is an equal force acting on the metering piston 58 in opposed directions, as indicated by arrows 84. Because the forces 84 are equal and opposed, the metering piston 58 is not displaced.

Figure 4:
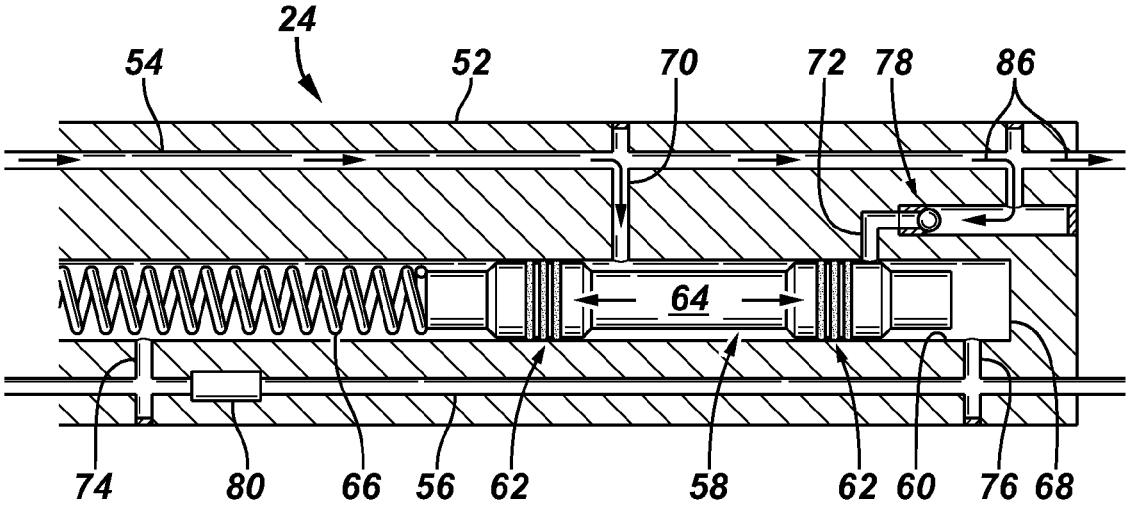
FIG. 4 is a schematic illustration similar to that of FIG. 3 illustrating fluid flow to the multi-position well tool, according to an embodiment of the present disclosure.
Figure 5:
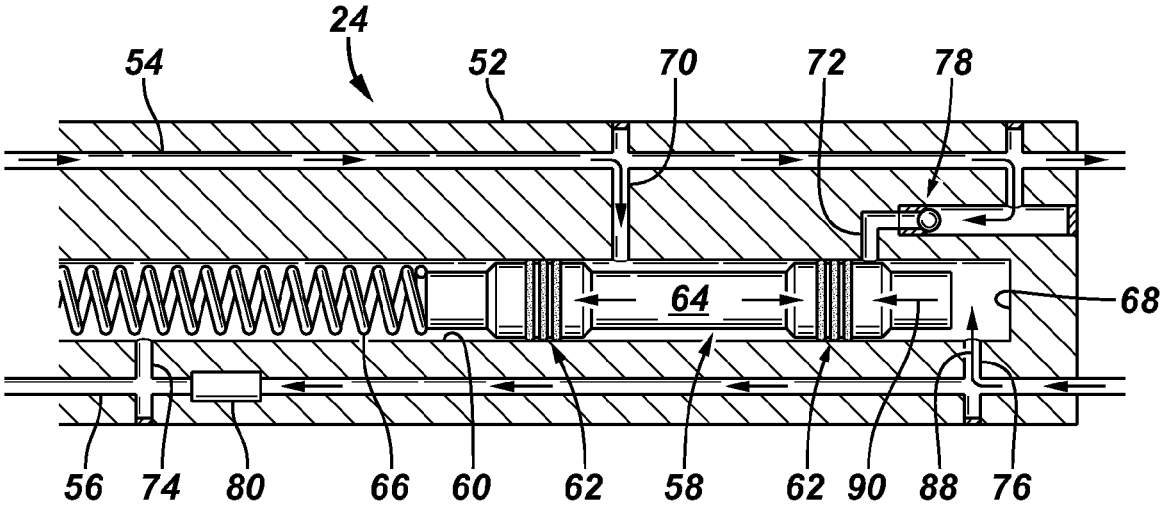
FIG. 5 is a schematic illustration similar to that of FIG. 4 but with the hydraulic control module in a different actuation position, according to an embodiment of the present disclosure.

The pressurized actuation fluid in first control line passage 54 also is communicated to check valve 78 and to the front side of multi-position tool 26 via tool connection 46 (see FIG. 2), as indicated by arrows 86 in FIG. 4. The check valve 78 prevents communication of the pressurized actuation fluid to metering piston cylinder 60 from this direction. However, when the actuation fluid is sufficiently pressurized, the actuation fluid flows through tool connection 46, into multi-position tool 26, and against a first side of actuator 44 to move actuator 44 in the direction of arrow 48 (see FIG. 2). As the actuator 44 is moved, actuation fluid is displaced on an opposite side of actuator 44 and communicated from the back side of the multi-position valve 26. The displaced actuation fluid flows through tool connection 50 and into second control line passage 56 of hydraulic control module 24, but flow in this direction through second control line passage 56 is blocked by pressure relief valve 80. Consequently, the displaced actuation fluid is forced into metering piston cylinder 60 through flow channel 76, as represented by arrow 88 in FIG. 5.

Figure 6:
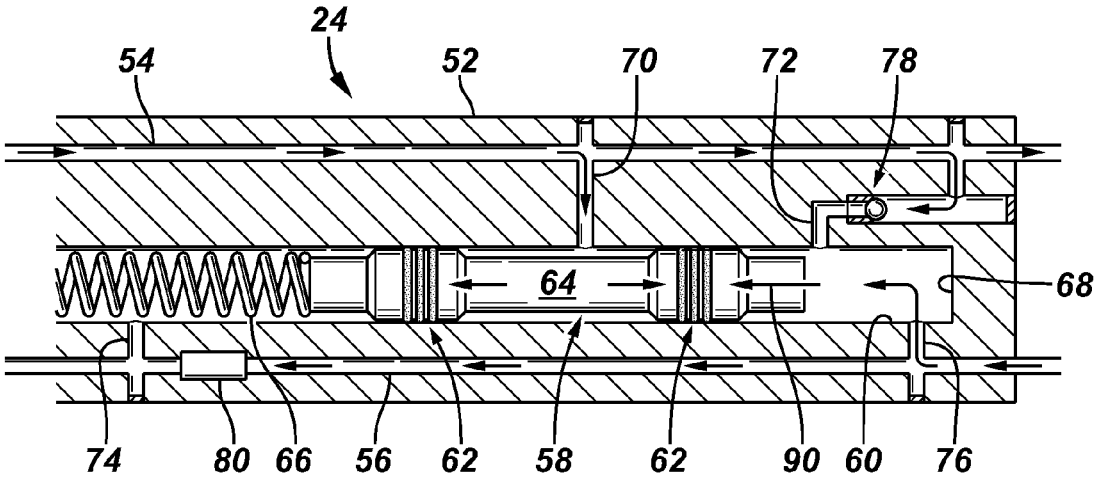
FIG. 6 is a schematic illustration similar to that of FIG. 5 but with the hydraulic control module in another actuation position, according to an embodiment of the present disclosure.

Movement of the displaced actuation fluid into metering piston cylinder 60 generally at end 68 creates a force imbalance across the piston seals 62 and causes the metering piston 58 to shift in a direction away from end 68 as indicated by arrow 90. The metering piston 58 continues to shift and compress spring member 66 as displaced actuation fluid continues to fill metering piston cylinder 60 at end 68, as illustrated in FIG. 6. Metering piston 58 moves in the direction of arrow 90 until the seal stack 62, farthest away from spring member 66, crosses the flow channel/port 70, as illustrated in FIG. 7.

Figure 7:
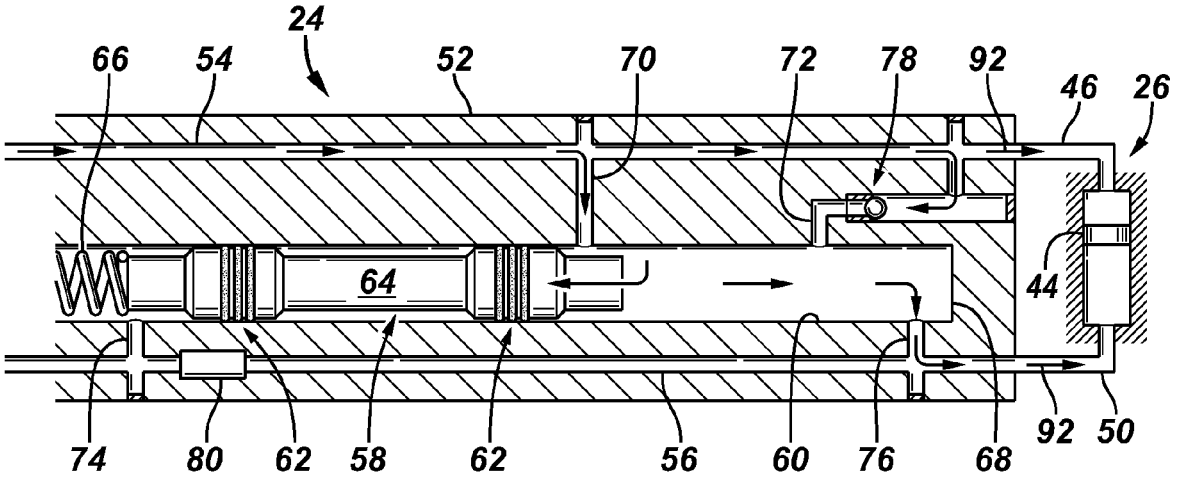
FIG. 7 is a schematic illustration similar to that of FIG. 6 but with the hydraulic control module in another actuation position, according to an embodiment of the present disclosure.

Once metering piston 58 is moved past flow channel 70, pressurized actuation fluid may be communicated directly from first control line passage 54 of first control line 38 (see FIG. 2) to both the front side and the back side of multi-position tool 26 via tool connections 46 and 50, as indicated by arrows 92 in FIG. 7. As a result, a pressure balance is created across actuator 44 that causes the multi-position tool 26 to stop shifting. In some applications, the pressure applied via first control line 38 may be allowed to increase to negate the effects of fluid/gas compressibility. The volume of hydraulic actuation fluid used in shifting the metering piston 58 across flow channel 70 equates to the volume of hydraulic fluid applied to multi-position tool 26 to transition the tool, via actuator 44, through one incremental position. Accordingly, FIG. 7 illustrates the multi-position tool 26 as successfully actuated to a next sequential, incremental position.

Figure 8:
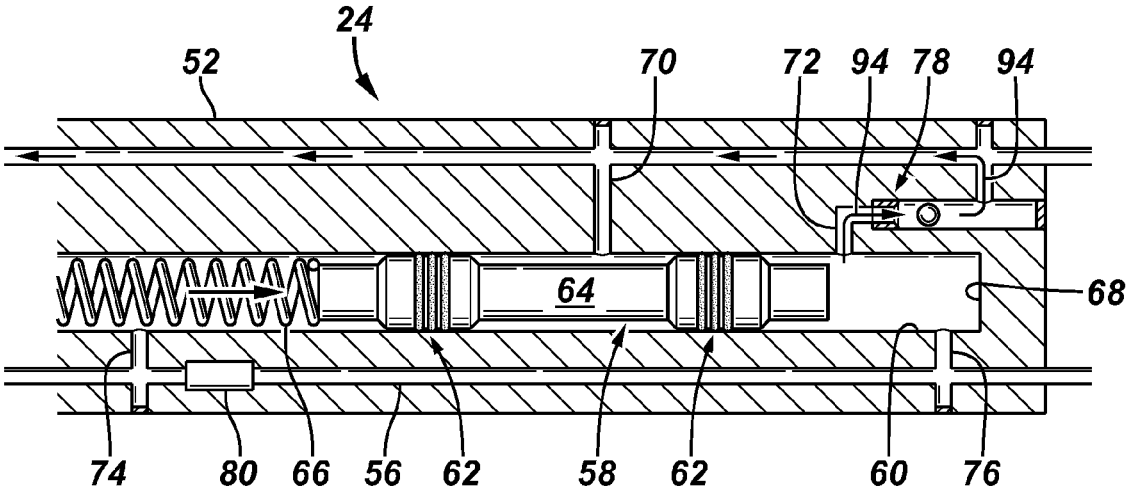
FIG. 8 is a schematic illustration similar to that of FIG. 7 but with the hydraulic control module in another actuation position, according to an embodiment of the present disclosure.

To shift multi-position tool 26 to subsequent, sequential actuation positions, pressure is bled from first control line 38. After sufficient pressure is bled, the force applied against metering piston 58 by spring member 66 is able to shift the metering piston 58 back to its original position toward metering piston cylinder end 68. As metering piston 58 is shifted back, actuation fluid is exhausted from metering piston cylinder 60 through check valve 78 and out through first control line 38, as illustrated by arrows 94 in FIG. 8. The actuation fluid exhausted from metering piston cylinder 60 does not vent back to the multi-position tool 26 via tool connection 46 due to the seal friction of actuator 44 within tool 26 (see FIG. 7).

Figure 9:
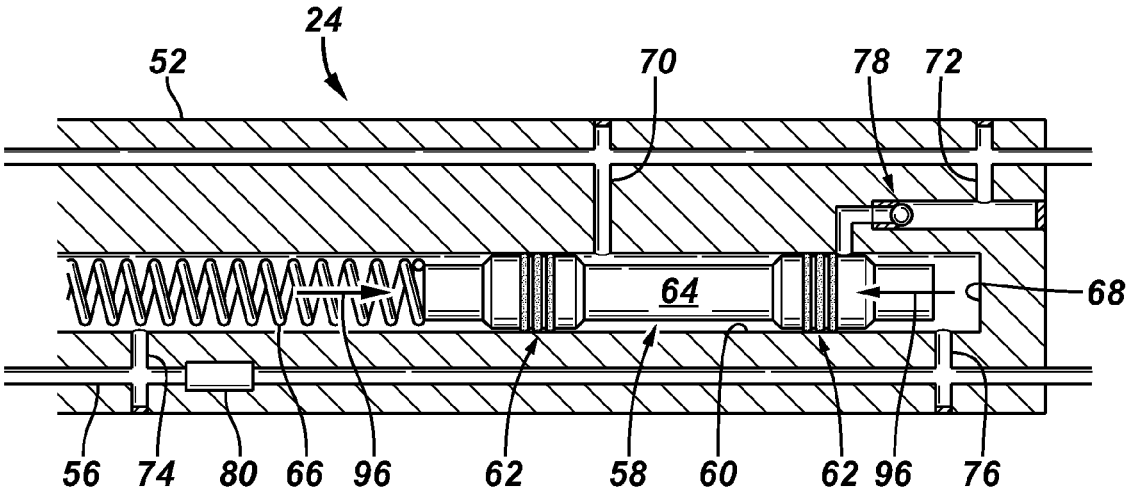
FIG. 9 is a schematic illustration similar to that of FIG. 8 but with the hydraulic control module in another actuation position, according to an embodiment of the present disclosure.

Spring member 66 moves metering piston 58 until its seal stack 62, farthest away from spring member 66, crosses the flow channel 72 leading back to check valve 78. With metering piston 58 in this position, the exit path for hydraulic actuation fluid exhausted from metering piston cylinder 60 is blocked. Consequently, a hydraulic lock occurs in the hydraulic control module 24 because the resultant static hydraulic pressure of actuation fluid remaining in metering piston cylinder 60 is equal to the spring force exerted by spring member 66, as indicated by arrows 96 in FIG. 9. At this stage, the metering piston 58 has been successfully returned to its original position and further shifting toward end 68 is stopped. The multi-position tool 26 may then be transitioned to its next incremental position by applying pressurized actuation fluid via first control line 38, as described above with reference to FIGS. 2-7. This process of applying increased pressure via first control line 38 and then decreasing the pressure to enable resetting of the metering piston 58 may be repeated as many times as necessary to transition tool 26 through its multiple incremental positions.

Figure 10:
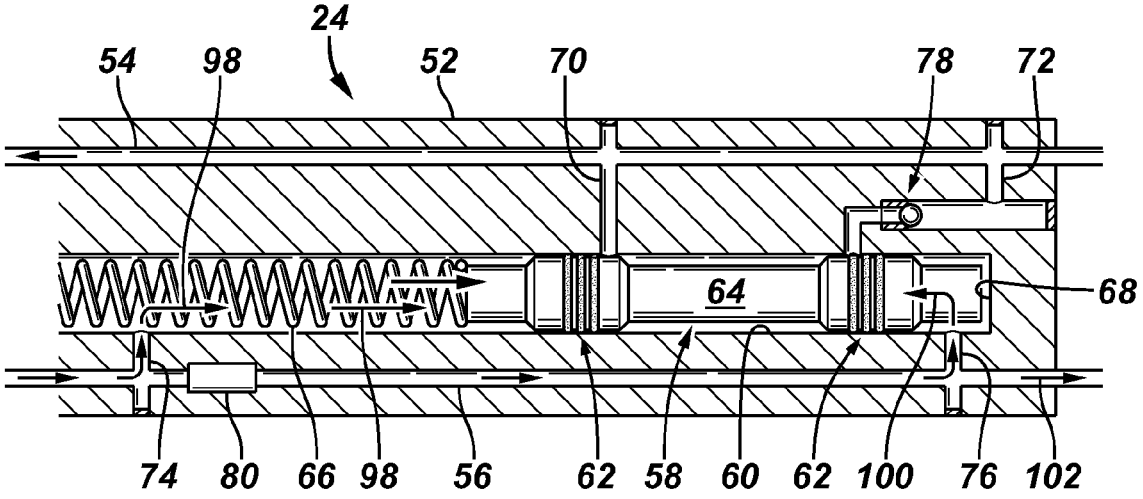
FIG. 10 is a schematic illustration similar to that of FIG. 9 but with the hydraulic control module in another actuation position, according to an embodiment of the present disclosure.

Furthermore, the multi-position tool 26 may be returned to its original position (as illustrated in FIG. 2) from any incremental position. If, for example, multi-position tool 26 is a multi-position flow control valve, the flow control valve may be returned to a closed position from a fully open position and from any incremental position between the closed position and the fully open position. To return tool 26 to its original position, pressurized actuation fluid is applied via second control line 40. The pressurized fluid enters second control line passage 56 and flows into metering piston cylinder 60 on the spring member side of metering piston 58 via flow channel 74, as indicated by arrows 98 in FIG. 10.

The pressurized actuation fluid in second control line passage 56 also flows through pressure relief valve 80 to an opposite side of metering piston 58 via flow channel 76, as indicated by arrows 100. However, pressure relief valve 80 creates a pressure differential across the metering piston 58 such that the force acting on the spring member side of metering piston 58 (see arrow 98) is greater than the force acting on the opposite side of metering piston 58. Consequently, metering piston 58 is shifted farther toward metering piston cylinder end 68, as illustrated best in FIG. 10. As shown, the metering piston 58 shifts toward end 68 while the seal stack 62, closest to end 68, moves to prevent pressurized actuation fluid in second control line passage 56 from being able to communicate through check valve 78 and back into first control line passage 54.

While metering piston 58 is preventing flow through check valve 78, the pressurized actuation fluid in second control line 40 flows through hydraulic control module 24, as represented by arrow 102. The pressurized fluid continues to flow through tool connection 50 and into the back side of multi-position tool 26 to force actuator 44 back to its original position. Actuation fluid on the front side of actuator 44 is exhausted through tool connection 46 and first control line 38.

Figure 11:
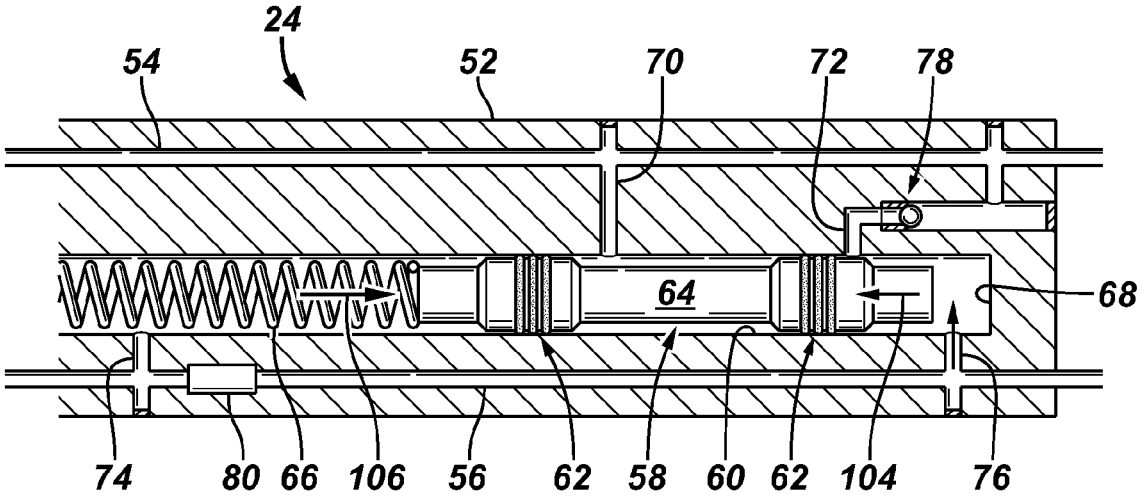
FIG. 11 is a schematic illustration similar to that of FIG. 10 but with the hydraulic control module in another actuation position, according to an embodiment of the present disclosure.

After returning the multi-position tool 26 to its initial position, pressure is bled from second control line 40. A certain amount of pressure is trapped on the back side of the multi-position tool 26 due to pressure relief valve 80. This pressure exerts a force on metering piston 58 through flow channel 76 and causes displacement of the metering piston 58 toward spring member 66, as indicated by arrow 104 in FIG. 11. The displacement of metering piston 58 continues until the trapped pressure can be relieved/exhausted through check valve 78 and out through first control line 38. Once this pressure has been exhausted, the force exerted by spring member 66, as represented by arrow 106, is able to move metering piston 58 back to its original position. At this stage, the process of incrementally advancing multi-position tool 26 to a desired incremental position may be repeated as desired.

Well system 20 may be constructed in a variety of configurations for use with many types of well systems in many types of environments. The actuation system 22 may be used in various completions or other types of downhole equipment for performing production operations, servicing operations, and other well related operations. The multi-position tool may comprise a multi-position flow control valve or a variety of other multi-position tools. Additionally, the size, components and materials of the hydraulic control module may be selected to accommodate specific types of multi-position tools and applications. Additionally, the configuration of the hydraulic control module housing, the arrangement of porting, the style of piston, the types of internal valves, and the features of other components may be adjusted according to the specific application.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few embodiments of the present invention have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system of tool actuation, comprising:

a multi-position downhole tool; and a hydraulic control module coupled to the multi-position downhole tool to control actuation of the multi-position downhole tool from an initial actuation position through a plurality of incremental actuation positions via a metering piston slidably disposed in a metering piston cylinder and based on receipt of pressurized actuation fluid from a first control line which delivers the pressurized actuation fluid through the hydraulic control module along a first control line passage separate from the metering piston, the hydraulic control module further controlling return of the multi-position downhole tool to the initial actuation position from any of the plurality of incremental actuation positions with a single pressure actuation from a second control line, the second control line delivering the single pressure actuation through the hydraulic control module along a second control line passage separate from the metering piston cylinder to provide a flow path to the multi-positioned downhole tool that does not enter the metering piston cylinder, the pressurized actuation fluid having a direct flow path to the multi-position downhole tool along the first control line passage without flowing into the metering piston cylinder, wherein movement through the plurality of incremental actuation positions is achieved with a series of pressure increases separated by pressure decreases in the first control line, the pressurized actuation fluid is exhausted through the first control when the multi-position downhole tool is returned to the initial actuation position, the hydraulic control module further comprises a spring member positioned to bias the metering piston toward an end of the metering piston cylinder, the first control line is connected to the metering piston cylinder at a first location and at a second distinct location and to a first side of the multi-position downhole tool, and the second control line is connected to the metering piston cylinder at a third location and at a fourth distinct location and to a second side of the multi-position downhole tool.

2. The system as recited in claim 1, wherein the multi-position downhole tool comprises a multi-position flow control valve.

3. The system as recited in claim 1, wherein the first control line is connected to the metering piston cylinder across a check valve at the second distinct location.

4. The system as recited in claim 3, wherein the second control line is connected to the multi-position downhole tool across a pressure relief valve.

5. A method of actuation, comprising:

coupling a hydraulic control module to a multi-position tool via a first connection on a first side of a tool actuator and via a second connection on a second side of the tool actuator;

connecting a first control line to the hydraulic control module to provide pressurized fluid to the first side of the tool actuator to move the tool actuator and a second control line to the hydraulic control module to provide pressurized fluid to the second side of the tool actuator;

using a metering piston slidably disposed in a metering piston cylinder located in the hydraulic control module to limit the amount of fluid that flows to the first side of the tool actuator through the first control line during each single level pressurization of the first control line to enable movement of the actuator through a plurality of incremental positions after an initial position;

actuating the actuator through the plurality of incremental positions by supplying pressurized fluid to the actuator from the first control line without routing the pressurized fluid to the actuator through the metering piston cylinder;

applying a single pressurization to the second control line to drive the actuator back to the initial position from any of the incremental positions by supplying pressurized fluid to the actuator without routing the pressurized fluid to the actuator through the metering piston cylinder;

wherein connecting comprises providing fluid flow channels between the first control line and the metering piston cylinder at a first location and at a second location selected to control the amount of fluid metered by the metering piston; and wherein connecting comprises providing a check valve in the flow channel between the first control line and the metering piston cylinder at the second location.

6. The method as recited in claim 5, wherein coupling comprises coupling the hydraulic control module to a multi-position flow control valve.

7. The method as recited in claim 5, wherein applying comprises applying the single pressurization through a pressure relief valve.

8. A system to control actuation of a tool in a well, comprising:

a hydraulic control module having a housing with a first control line passage therethrough and a metering piston external to the first control line passage but in fluid communication with the first control line passage via at least two flow channels, the metering piston controlling the amount of actuation fluid passing through the hydraulic control module via the first control line passage during each pressurization of the first control line passage, the hydraulic control module further comprising a second control line passage external to the metering piston while being in fluid communication with the metering piston via at least two additional flow channels in a manner which enables continued flow of fluid through the hydraulic control module and external to the metering piston during a single pressurization of the second control line passage to return the multi-position tool to an original position from any incremental position, wherein the metering piston comprises a pair of seal stacks separated by a middle region, the seal stacks sealing against a surrounding wall of a metering piston cylinder, wherein the hydraulic control module comprises a spring member positioned to, bias the metering piston toward an end of the metering piston cylinder, and wherein the hydraulic control module comprises a pressure relief valve in the second control line passage, the pressure relief valve being selected to allow flow of a sufficiently pressurized fluid through the hydraulic control module via the second control line passage.

9. The system as recited in claim 8, further comprising a multi-position flow control valve having an actuator coupled to the first control line on a front side and to the second control line on a back side.

* * * * *